United States Patent [19]

Lozano

[11] Patent Number: 4,986,587

[45] Date of Patent: Jan. 22, 1991

[54] REFUSE COLLECTING DEVICE

[76] Inventor: Amaro Lozano, 2833 Virginia Ave., Anaheim, Calif. 92806

[21] Appl. No.: 497,708

[22] Filed: Mar. 23, 1990

Related U.S. Application Data

[63] Continuation-in-part of Ser. No. 410,667, Sep. 21, 1989, abandoned, which is a continuation of Ser. No. 192,931, May 10, 1988, abandoned.

[51] Int. Cl.[5] ..... A01K 29/00; E01H 1/12

[52] U.S. Cl. ..... 294/1.4; 15/257.1; 294/55

[58] Field of Search ..... 294/1.3–1.5, 294/19.1, 49, 53.5, 55, 57; 15/104.8, 257.1, 257.3, 257.4, 257.7; 141/108, 109, 390, 391; 403/108, 109, 327, 329

[56] References Cited

U.S. PATENT DOCUMENTS

| | | | |
|---|---|---|---|
| 861,107 | 7/1907 | Goggin | 294/55 X |
| 2,800,737 | 7/1957 | Crossan | 403/108 X |
| 3,942,831 | 3/1976 | Sosnove | 294/1.4 |
| 4,012,067 | 3/1977 | Travis | 294/1.4 |
| 4,149,745 | 4/1979 | Willis | 294/1.4 |
| 4,200,321 | 4/1980 | Warkentin | 294/1.4 |
| 4,236,741 | 12/1980 | Emme | 294/1.5 |
| 4,247,216 | 1/1981 | Pansini | 403/109 |
| 4,257,635 | 3/1981 | Mainprice | 294/1.4 |
| 4,447,082 | 5/1984 | Lindholm | 294/1.4 |
| 4,705,310 | 11/1987 | Scripter | 294/1.4 |

FOREIGN PATENT DOCUMENTS

| | | | |
|---|---|---|---|
| 2426772 | 1/1980 | France | 294/1.4 |
| 2444752 | 8/1980 | France | 294/1.4 |

*Primary Examiner*—Johnny D. Cherry

*Attorney, Agent, or Firm*—Plante Strauss Vanderburgh and Connors

[57] ABSTRACT

A animal waste collection device consists of a scoop for picking up refuse, a handle to which the scoop is affixed for manipulation of the device and a removably attached refuse container carried by the handle. The refuse container can be attached and removed without touching the scoop of the device. The handle comprises at least two segments which are connected at their corresponding ends for full extension during manipulation of the device and which can be folded or disconnected in order to shorten the handle for storing the device. The lower end of the handle section to which the scoop portion is attached is adapted to removably attach a refuse bag for receiving the collected refuse.

1 Claim, 2 Drawing Sheets

REFUSE COLLECTING DEVICE

RELATIONSHIP TO PENDING APPLICATION

This application is a continuation in part of co-pending application Ser. No. 07/410,667, filed Sept. 21, 1989, now abandoned, which is a continuation of application Ser. No. 07/192,931, filed May 10, 1988, now abandoned.

FIELD OF THE INVENTION

This invention relates generally to apparatus for the collection of refuse, and more particularly to apparatus for the collection and disposal of animal feces.

BACKGROUND OF THE INVENTION

Various devices are disclosed in the art which relate to the collection and disposal of refuse, particularly animal excrement from grass, sidewalks and the like. Examples of such devices are disclosed in U.S. Pat. No. 4,447,082, Linholm, granted May 8, 1984; U.S. Pat. No. 3,281,178, Fisher, granted Sept. 29, 1964; U.S. Pat. No. 3,659,891, Pettenon et al, granted May 2, 1972; U.S. Pat. No. 3,677,596, Yonates et al, granted July 18, 1972; U.S. Pat. No. 3,942,831, Sosnove, granted Mar. 9, 1976; U.S. Pat. No. 4,149,745, Willis, granted Apr. 17, 1979; U.S. Pat. No. 4,200,321, Warkentin, granted Apr. 29, 1980.

The above devices relate to various manually operated refuse collectors which are particularly designed for collecting animal feces and the like and which generally comprise a scoop portion for picking up the refuse, a handle secured to the scoop portion for manipulating the device and a refuse container which is removably attached to the scoop portion.

The principle of operation of all of the aforementioned devices is essentially the same; that is the handle means is utilized to manipulate the scoop to pick up the refuse which can then be collected in the collection means, generally a removable replaceable bag for disposal. Several of these devices, however, have relatively short handles which require the operator to stoop in order to reach the ground with the scoop. Those with substantially longer handles do not provide for any method for retracting the handle for more convenient storage. More importantly, however, all of the devices require the operator to attach the refuse container directly to the scoop portion of the devices. This presents a high risk that the operator will touch the scoop portion of the device when attaching or removing the refuse collector which can be a distasteful operation for some operators and in any event may pose a health hazard to the operator should he come in contact with animal fecal material.

SUMMARY OF THE INVENTION

It is an object of the invention to provide a device for collecting animal refuse and the like which is convenient to operate and which minimizes the distasteful nature of the operation.

It is another object of the invention to provide a device which can be readily stored in a small space yet which has a handle which can be extended for manipulation by an operator in the standing position.

Yet another object of the invention is to provide a refuse collection device having removable refuse container means which is conveniently attached and detached without the necessity of contacting the collection portion of the device.

The foregoing objects and advantages are achieved by the present invention which comprises a refuse collection portion for picking up refuse, a handle to which the collection portion is affixed for manipulation of the device and means carried by the handle for removably attaching a suitable refuse container such as a bag or the like. The refuse container can be attached and removed without touching the refuse collection portion of the device. The handle comprises at least two segments which are connected at their corresponding ends for full extension during manipulation of the device and which can be folded or disconnected in order to shorten the handle for storing the device.

In one embodiment of the invention the handle sections are pivotally connected for movement between a folded storage position and an extended manipulation position.

In another embodiment the corresponding ends of the handle sections are adapted so that an end portion of one section is received in the other and locking means are provided for retaining the sections in an extended manipulating position. For storage the sections are disassembled.

In accordance with the invention, the lower end of the handle section to which the scoop portion is attached is adapted to removably attach a refuse bag for receiving the collected refuse. The bag is attached and detached without the necessity of the operator touching the collection portion of the device.

These and other objects and advantages of the present invention will become apparent from the following detailed description taken in conjunction with the following drawings.

DETAILED DESCRIPTION OF THE INVENTION

Figure 1:
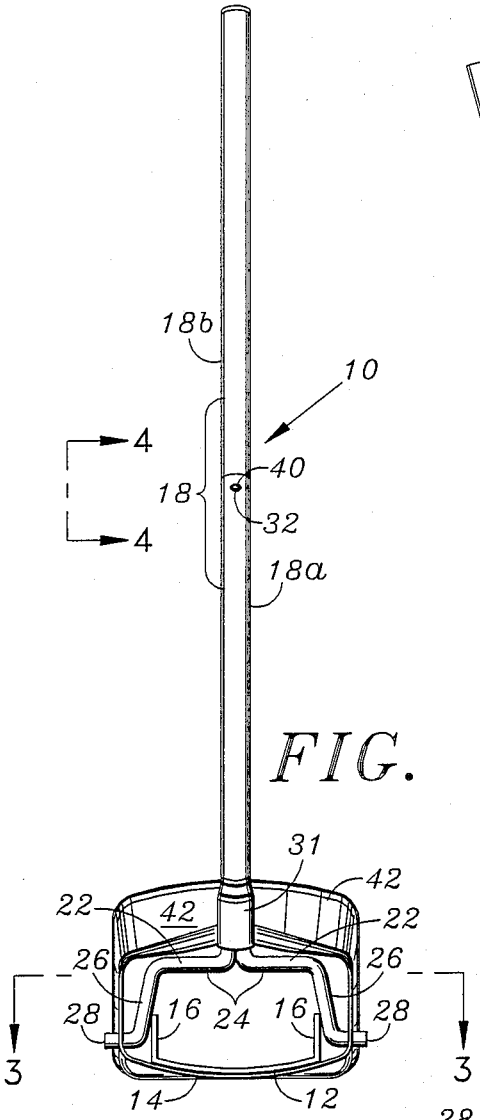
FIG. 1 is a front elevation of the refuse collection device constructed in accordance with the present invention and showing a refuse collection bag attached to the device.
Figure 2:
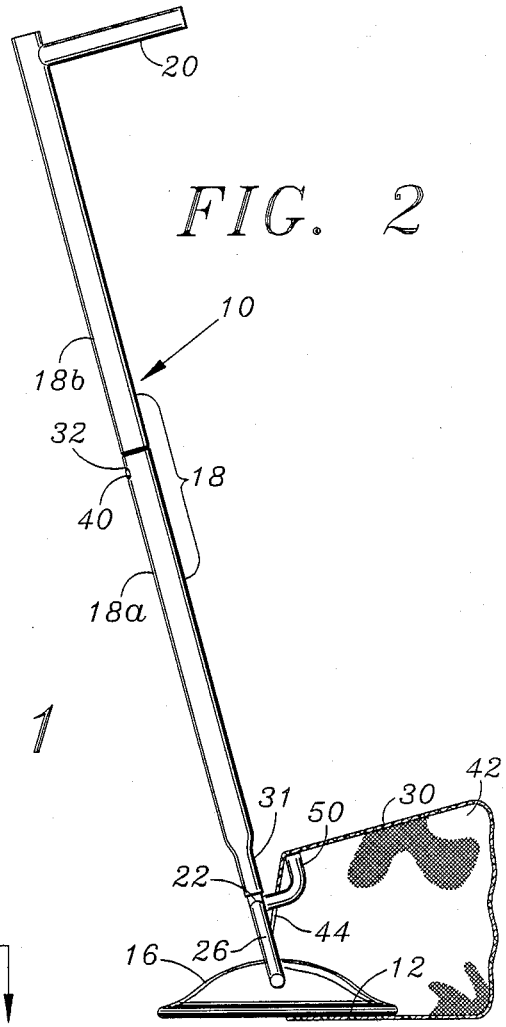
FIG. 2 is a side elevation showing the refuse container in partial section.
Figure 3:
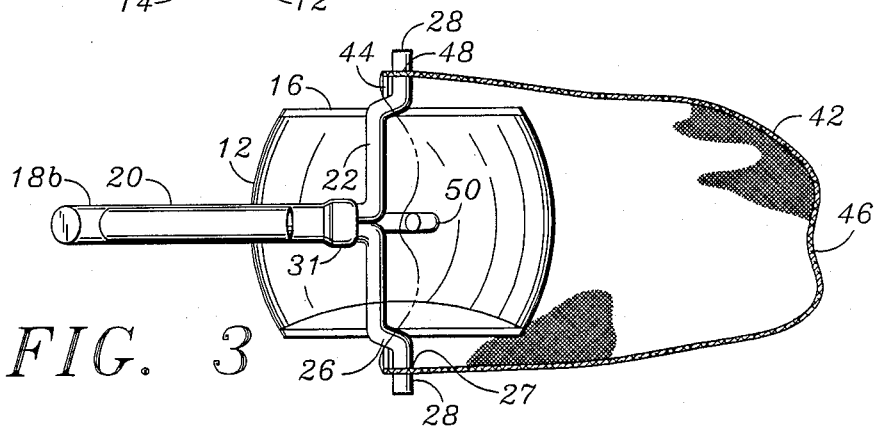
FIG. 3 is a top elevation, partially broken away for compactness of illustration and partially in section as viewed along line 3—3 of FIG. 1.

Referring to FIGS. 1-3, the device of the present invention, shown generally as 10, comprises a scoop portion 12 comprising a bottom wall 14 with normally extending edge portions 16 which define side walls for the scoop portion 12. A handle post 18 comprises a lower tubular section **18*a* and an upper tubular section 18*b*. The upper section 18*b* includes a perpendicularly extending handle 20 as an aid for manipulating the device 10. The lower end of the tubular section 18*a* is adapted for permanent connection to the scoop portion 12 by a pair of opposed rods 22 which are formed with downwardly extending connecting legs 26 to which are permanently affixed the sidewalls 16 of the scoop portion 12. The scoop portion 12 and the arms 22 may be affixed by any suitable means such as welding or by bolts or metal screws, not shown. The ends of the legs 26 terminate in outwardly extending posts 28 which cooperate in the manner described below for the removable attachment of a refuse collection bag 30. In the preferred embodiment, the rods 22 are permanently connected to the lower tubular section 18*a* by crimping a portion 31 of the lower tubular section 18*a* about parallel extending end portions of the rods 22**.

Figure 4:
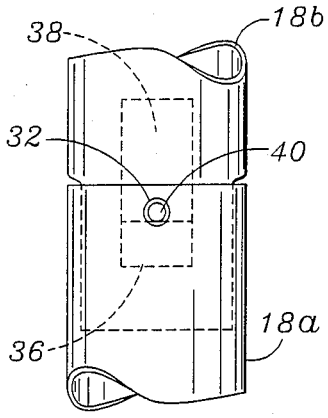
FIG. 4 is a portion of the handle of the device of FIG. 1 in enlarged scale and taken along line 4—4 of FIG. 1 illustrating one manner of connecting the handle sections.
Figure 5:
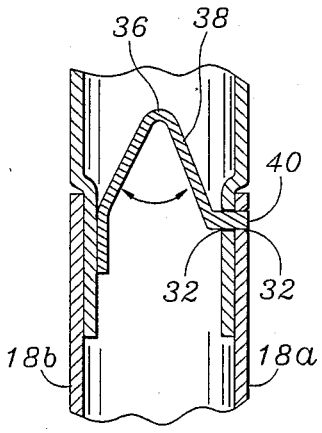
FIG. 5 is a sectional view of FIG.4 illustrating the locking means for the handle sections.
Figure 6:
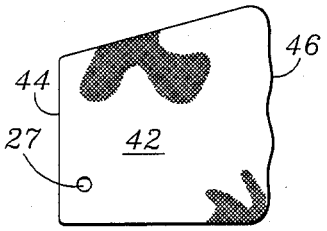
FIG. 6 is a side elevation of the refuse container bag illustrated in FIG. 1.

Referring now to FIGS. 4 and 5, the tubular sections **18*a* and 18*b* are adapted for connection by means of the end portion of one of the sections, 18*a* as illustrated, being of reduced diameter so as to be received in the bore of the corresponding section, 18*b*. Each of the corresponding ends of the sections 18*a* and 18*b* is provided with an opening 32 and the openings are aligned when the corresponding ends of the sections 18*a* and 18*b* are joined. A spring member 36 is formed from an elongated spring metal body which is bent back on itself to define a pair of legs 38 which are normally urged apart by action of spring member 36. A locking pin 40 is carried on the end of one of the legs 38 to extend through the openings 32 of the sections 18*a* and 18*b* when the openings 32** are aligned to lock the sections together.

A disposable refuse bag 42, preferably made of paper or polyethylene or the like, having an open mouth 44 and a sealed bottom wall 46 is removably attached to the device 10 to receive the refuse picked up by the scoop portion 12. The side walls of the refuse bag are adapted for connection to the device 10 by means of aligned holes 27 through which extend the posts 28 on the connecting legs 26 of the device 10. The mouth is held in an open position by the provision of an L-shaped member 50 which is affixed to the device 10 at the lower end of the section **18*a* and which extends rearwardly from the lower section 18*a* with the base extending upwardly to define a supporting member 52 to hold open the mouth 44 of the refuse bag 42, the lower edge of the bag being under the bottom wall 14 of the scoop portion 12**.

In operation, it is preferred to assemble the ends of the sections **18*a* and 18*b* by sliding the reduced diameter portion of the section 18*a* in the bore of the section 18*b* and aligning the openings 32. The locking pin 40 should be depressed to permit the reduced end of the section 18*a* to slide freely into the bore of the section 18*b*. The spring action of the member 36 urges the locking pin 40 through the aligned openings 32 to lock the sections together. The refuse bag is then affixed to the scoop portion 12 by inserting the rear edge of the scoop portion 12 in the mouth of the bag 42, passing the ends of the posts 28 through the holes 48 in the bag and then looping the upper portion of the mouth of the bag 42 over the support 52 formed by the L-shaped member 50 to hold open the mouth 44 of the bag 42. The device is operated by placing the front edge of the scoop portion 12 under the refuse and moving the device in a forward direction so that the refuse is lifted from the ground and placed on the bottom wall 14 of the scoop portion 12. The device is then rocked toward the operator to cause the refuse to slide from the scoop portion into the refuse bag 42. Upon completion of the operation, the bag is removed from the device 10 without the necessity of contacting the scoop portion 12 by simply lifting the upper edge of the bag 42 off the support member 52 and then simply removing the bag from the posts 28**.

In the preferred form of the invention as illustrated in FIGS. 1, 2 and 3, the scoop portion 12 and the handle post 18 are connected so that when fully assembled, the handle post 18 extends in a forward direction approximately 10 to 20 degrees from vertical when the bottom wall 14 of the scoop portion 12 is horizontal. This aids in allowing the operator to tilt the scoop portion 12 so that the refuse falls naturally into the refuse bag 42.

When the device is not in use the handle 18 may be disassembled for ready storage by depressing the upper portion of the locking pin 40 below the opening 32 of the upper section **18*b* so that the section can be removed from the lower section 18*a*. If desired, the device may be utilized using only the lower section 18*a*** although this is not preferred since it is necessary to stoop or squat in order to manipulate the device.

As will be understood by those skilled in the art, various arrangements other than those described in detail in the specification will occur to those persons skilled in the art which arrangements lie within the spirit and scope of the invention. It is therefor to be understood that the invention is to be limited only by the claims appended hereto.

Having described the invention, I claim:

1. A manually operated refuse collecting device comprising:

an elongated handle comprising an upper and a lower section, said sections being removably connected together;

a scoop portion comprising a bottom wall with normally extending edge portions which define side walls;

a disposable refuse collection container removably attached to said device to receive the refuse from said scoop portion;

means disposed at one end of said lower section of said handle to secure said scoop portion thereto and to removably attach said disposable refuse collection container;

said means comprising a pair of opposed arms, each having a portion extending normally from the longitudinal axis of said lower section and terminating in a connection portion which extends parallel to the longitudinal axis of said lower section, said scoop portion of said device being disposed between said connection portions of said arms with each said arm secured to a sidewall of said scoop portion, attachment posts for said refuse collection container defined by outwardly extending ends of said connection portions of said arms and an L-shaped member affixed to said lower section and extending therefrom to define a support for the open mouth of an attached disposable refuse collection container.

* * * * *